US007186953B2

(12) United States Patent
Wu et al.

(10) Patent No.: US 7,186,953 B2
(45) Date of Patent: Mar. 6, 2007

(54) MERCURY-HEATING DEVICE AND METHOD OF MANUFACTURING THE SAME

(75) Inventors: Jiun-Han Wu, Sanchung (TW); Wei-Yuan Tsou, Hsinchu (TW); Horng-Bin Hsu, Taipei (TW)

(73) Assignee: Au Optronics Corp., Hsin-Chu (TW)

( * ) Notice: Subject to any disclaimer, the term of this patent is extended or adjusted under 35 U.S.C. 154(b) by 0 days.

(21) Appl. No.: 11/141,035

(22) Filed: Jun. 1, 2005

(65) Prior Publication Data

US 2006/0087209 A1 Apr. 27, 2006

(30) Foreign Application Priority Data

Oct. 22, 2004 (TW) ..... 93132193 A

(51) Int. Cl.
*H05B 11/00* (2006.01)
*H01J 61/04* (2006.01)

(52) U.S. Cl. ..... 219/220; 313/15; 313/491

(58) Field of Classification Search ..... 219/220, 219/216; 200/182; 313/491
See application file for complete search history.

(56) References Cited

U.S. PATENT DOCUMENTS 3,947,713 A 3/1976 Przybylek
4,922,078 A * 5/1990 Ulrich et al. ..... 219/216
4,978,888 A * 12/1990 Anandan et al. ..... 315/58
6,087,201 A * 7/2000 Takahashi et al. ..... 438/106
6,114,809 A * 9/2000 Winsor ..... 315/50
6,693,682 B2 * 2/2004 Fujishiro et al. ..... 349/65
6,806,431 B2 * 10/2004 Kondoh et al. ..... 200/182
6,825,429 B2 * 11/2004 Dove et al. ..... 200/302.1
6,924,464 B2 * 8/2005 Zhou et al. ..... 219/444.1
6,933,669 B2 * 8/2005 Jean et al. ..... 313/491

FOREIGN PATENT DOCUMENTS

JP 2004-134410 4/2004

* cited by examiner

*Primary Examiner*—Robin Evans
*Assistant Examiner*—Vinod Patel
(74) *Attorney, Agent, or Firm*—Rabin & Berdo, PC

(57) ABSTRACT

A mercury-heating device is provided. The device is disposed on a substrate of a planar light source. The heating device includes a patterned electrode and a container. The patterned electrode is formed on the substrate and coupled to an external power source. The container, which covers over the patterned electrode, is a dielectric layer formed on the substrate. The container is used for containing mercury alloy or liquid mercury.

15 Claims, 5 Drawing Sheets

MERCURY-HEATING DEVICE AND METHOD OF MANUFACTURING THE SAME

This application claims the benefit of Taiwan Patent application Serial No. 93132193, filed Oct. 22, 2004, the subject matter of which is incorporated herein by reference.

BACKGROUND OF THE INVENTION

1. Field of the Invention

The invention relates in general to a planar light source and more particularly to a light source with a mercury-heating device.

2. Description of the Related Art

After the invention of bulbs, the night life has become various and colorful. As a result of the progress of the technologies, the form and the type of the light source has become much more various. For instance, the light-emitting diode, the fluorescent lamp, tungsten filaments and the planar fluorescent lamp are nowadays popular and widely used.

The light-emitting diode can be applied on neon lamp, or electrical devices. Fluorescent lamps are widely used in indoor illumination. Tungsten filaments provide both light and heat. As for the planar fluorescent lamp, it is frequently used for providing backlight in the liquid crystal display.

Under conventionally process of producing planar fluorescent lamp, the mercury alloy is located in the planar fluorescent lamp. By means of a radio frequency heater, mercury alloy is heated and transformed into mercury vapor. Mercury vapor spreads over the planar fluorescent lamp uniformly and condenses into liquid mercury. When external electric field is applied to the planar fluorescent lamp and gas discharge occurs, mercury is excited to the excited state. When the excited mercury returns to the ground state, ultraviolet light is emitted to excite the fluorescent powder on the inner surface of the planar fluorescent lamp and visible light is generated.

In general, to transform the mercury alloy into the mercury vapor, the mercury alloy should be heated around 800° C.~900° C. for more than 30 seconds. Consequentially, the electrical energy and time consumption is relatively essential. In addition, the cost of the radio frequency heater is high, and the process of heating using radio frequency heater is complex.

SUMMARY OF THE INVENTION

It is therefore an object of the invention to provide a heating device, which is disposed on the planar light source. By heating the liquid mercury directly instead of heating the mercury alloy, the heating device saves the time, the energy and the cost of radio frequency heater.

The invention achieves the above-identified object by providing a heating device. The heating device includes a patterned electrode and a container. The patterned electrode is formed on the lower substrate and electrically connected to an external power source to heat liquid mercury. The patterned electrode is covered with a dielectric layer which forms the container to contain to-be-excited member.

The invention achieves the above-identified object by further providing a planar light source. The light source includes an upper substrate, a lower substrate and a heating device. The lower substrate is substantially parallel to the upper substrate, and the heating device is disposed between the lower substrate and the upper substrate. The heating device comprises patterned electrode and a container. The patterned electrode is formed on the lower substrate and electrically connected to an external power source to heat. The patterned electrode is under a dielectric layer, which forms the container to contain to-be-excited member.

The invention achieves the above-identified object by providing a method for producing a planar light source with a heating device. First, the patterned electrode is formed on the lower substrate by screen printing, electroplating or other process. Next, a dielectric layer is formed on the patterned electrode and the lower substrate by screen printing or other process and a container filled with to-be-excited member is defined on the dielectric layer. Next, an upper substrate is sealed with the lower substrate with discharge gas between. At last, the patterned electrode is electrically connected to an external power source so that the to-be-excited member can be heated by the patterned electrode through the dielectric layer.

Other objects, features, and advantages of the invention will become apparent from the following detailed description of the preferred but non-limiting embodiments. The following description is made with reference to the accompanying drawings.

DETAILED DESCRIPTION OF THE INVENTION

First Embodiment

Figure 1A:
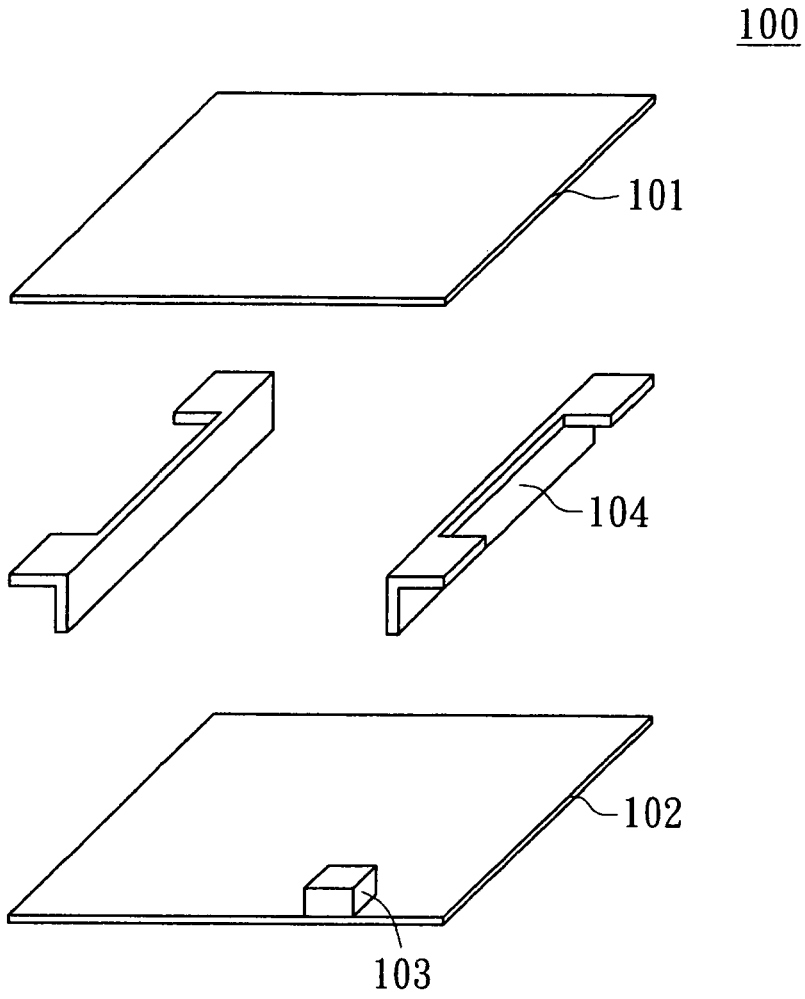
FIG. 1A is the exploded view of the planar light source in the first embodiment.

Referring to FIG. 1A, the exploded view of the planar light source in the first embodiment is shown. As shown in FIG. 1A, the planar light source comprises of an upper substrate 101, a lower substrate 102, a heating device 103 and two electrodes 104. The lower substrate 102 is disposed substantially parallel to the upper substrate 101. The two electrodes 104 and the heating device 103 are disposed on the lower substrate 102. The upper substrate 101 and the lower substrate 102 are transparent or semi-transparent.

Figure 1B:
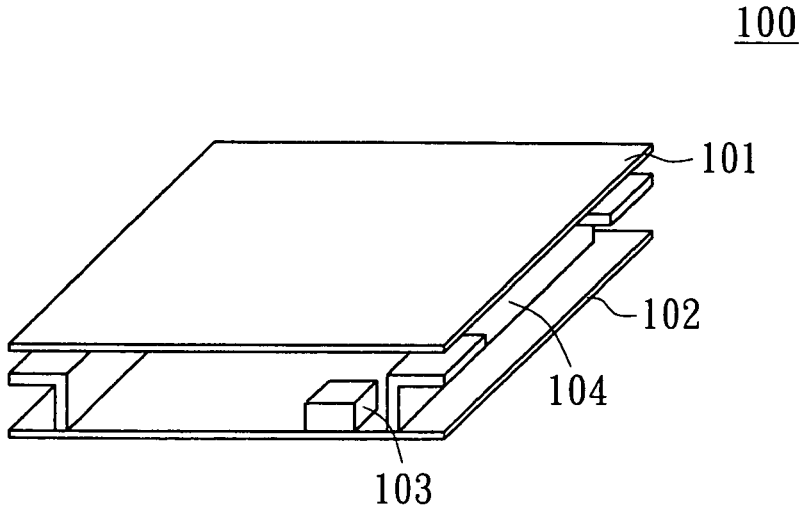
FIG. 1B is the perspective view of the planar light source with a heating device in the first embodiment.

Referring to FIG. 1B, the perspective view of the planar light source with heating device in the first embodiment is shown. The heating device 103 is disposed between the lower substrate 102 and the upper substrate 101. The two electrodes 104 are the electrodes of the planar light source 100. As shown in FIG. 1A, the heating device 103 may be located between the two electrodes 104 or outside of the two electrodes 104 (not shown in FIG. 1A).

Figure 1C:
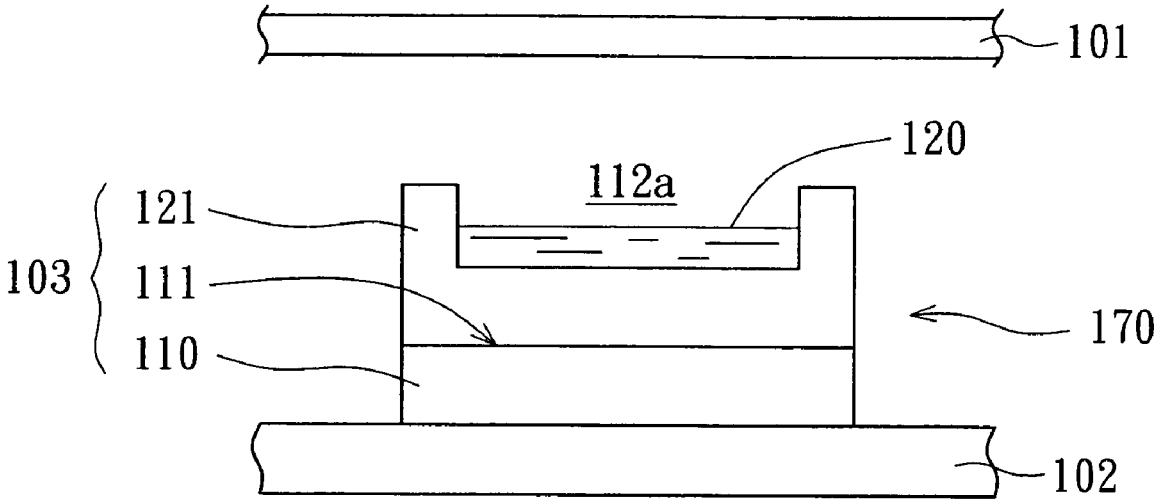
FIG. 1C is the cross-section view of the heating device.

Referring to FIG. 1C, the cross-section view of heating device is shown. The heating device 103 comprises of a patterned electrode 110 and a container 112*a*. As shown in FIG. 1C, the container 112*a* is an open box-shaped region 121 with a base and surrounded by a closed wall. The patterned electrode 110 and the container 112*a* are formed on the lower substrate 102. The container 112*a* is constructed by the dielectric layer 111 and substantially over the patterned electrode 110. The container 112*a* is used for containing to-be-excited member 120. Besides, the to-be-excited member 120 can be mercury alloy or liquid mercury. When the patterned electrode 110 is connected to an external power source, (not shown in FIG. 1C) the resistance of the patterned electrode 110 generates heat to heat the to-be-excited member 120 into mercury vapor. The mercury vapor is then spread evenly all over the planar light source 100.

Figure 1D:
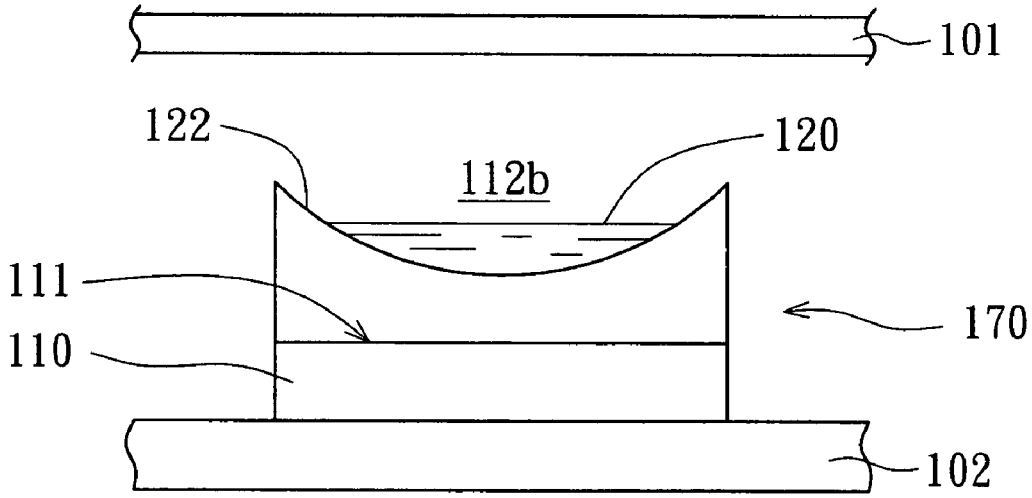
FIG. 1D is the cross-section view of a concave container.
Figure 1E:
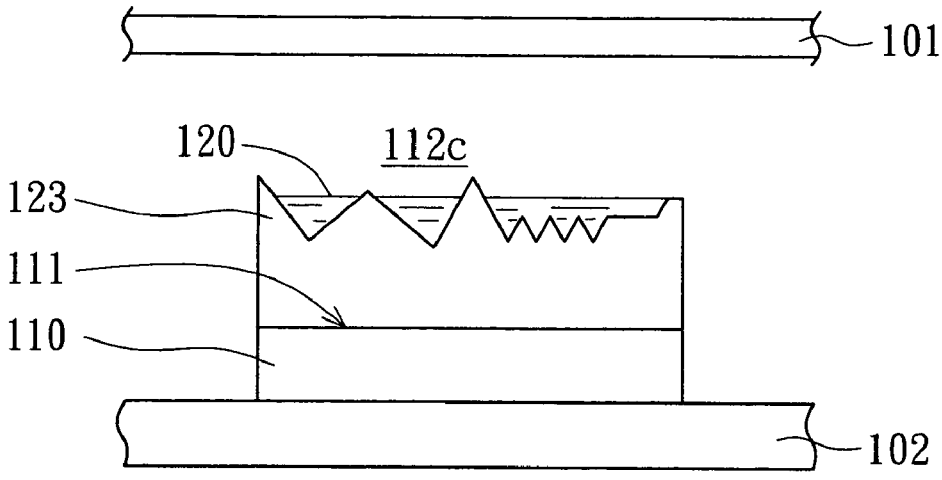
FIG. 1E is the cross-section view of another shape of the container.

The shape of the container 112*a* is not limited to the open box-shaped 121 with a base and a closed wall. Any shape able to contain the mercury alloy or liquid mercury is an alternative. Referring to FIG. 1D, the cross-section view of a concave container 122 is different from the open box-shaped but is capable of containing the to-be-excited mercury 120. Referring to FIG. 1E, another shape of the container is shown. The container in FIG. 1E has a rough surface and is able to contain the to-be-excited member 120. The container, with alternative shapes 112*a*, 112*b* and 112*c* shown in FIG. 1C, FIG. 1D and FIG. 1E, limits the to-be-excited member 120 in a particular region and prevents the liquid mercury from flowing elsewhere.

Second Embodiment

Figure 2A:
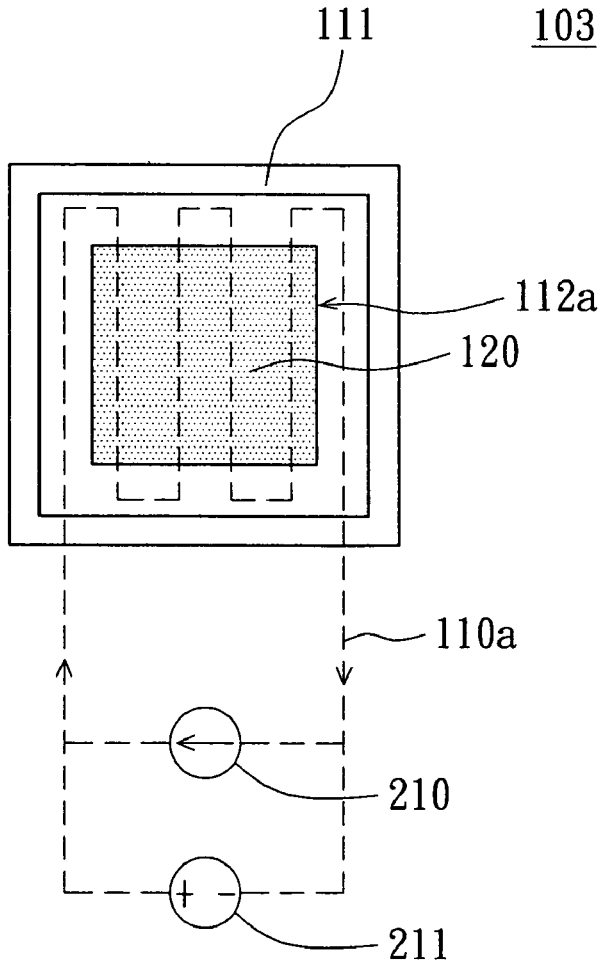
FIG. 2A is the top view of the patterned electrode in the first embodiment.

Referring to FIG. 2A, the top view of the patterned electrode in the first embodiment is shown. The patterned electrode 110*a* is disposed on the lower substrate 102. And the patterned electrode 110*a* is formed in a sequential square wave shape. When the two ends of the patterned electrode 110*a* are electrically connected to the external power source, which can be either a current source 210 or a voltage source 211, the resistance of the patterned electrode 110*a* will generate the heat. The dielectric layer 111 conducts heat to the to-be-excited member 120, and the to-be-excited member 120 is transformed into mercury vapor and spreads evenly all over the planar light source. Moreover, to prevent the to-be-excited member 120 from being electrically connected to the patterned electrode 110*a*, the dielectric layer 111 should be thermal conductive but electrical insulating. Preferably, the dielectric layer 111 is made of the glass powder, containing lead and silicon oxide.

Figure 2B:
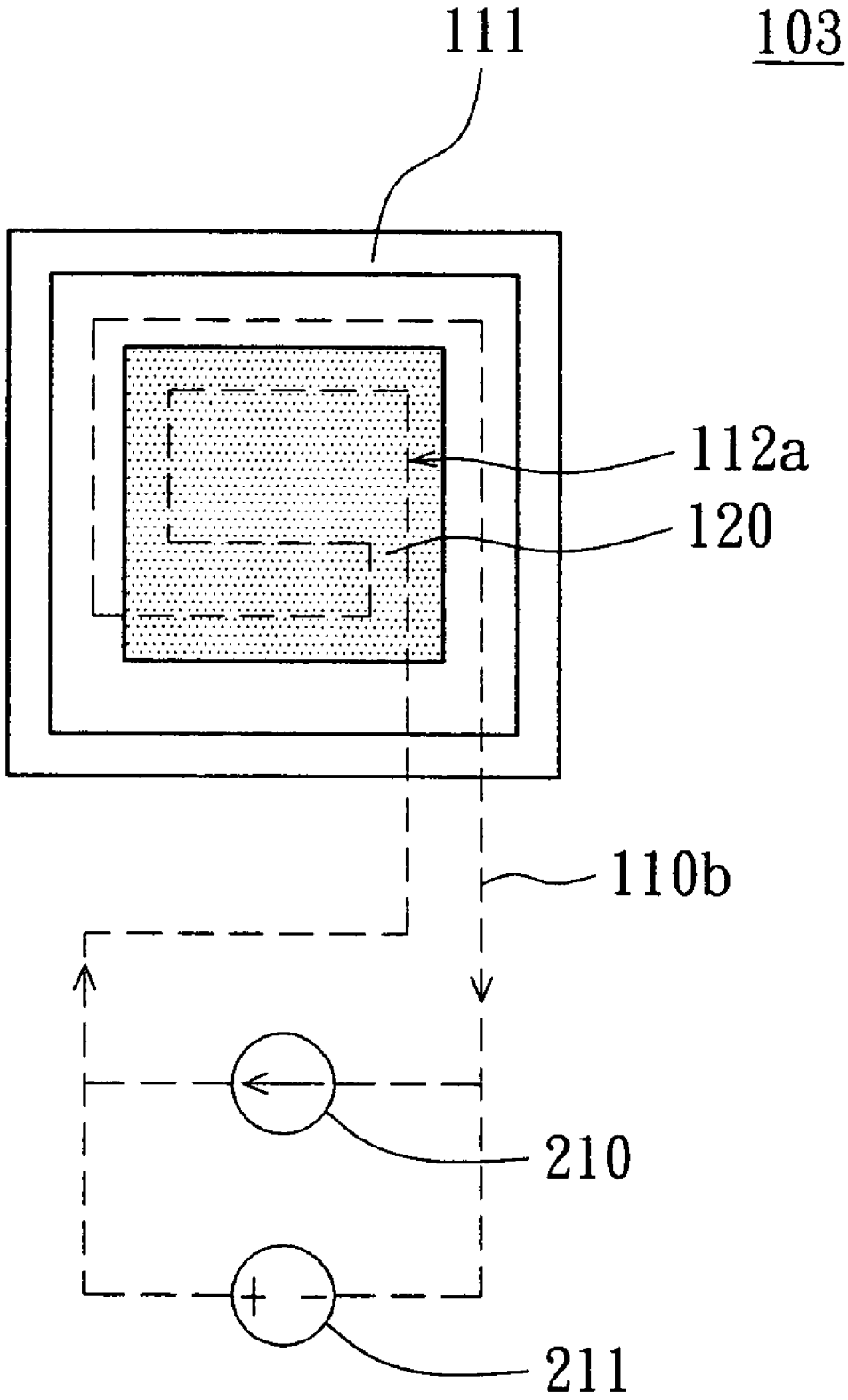
FIG. 2B is the top view of the second embodiment of the patterned electrode.

Referring to FIG. 2B, the top view of the patterned electrode in the second embodiment is shown. The patterned electrode 110*b* in the embodiment is whirlpool-shaped. When the two ends of the patterned electrode 110*b* are electrically connected to the power source, the resistance of the patterned electrode 110*a* will generate the heat. And the power source can be a current source 210 or the voltage source 211. In virtue of the whirlpool-shaped patterned electrode, the whirlpool-shaped patterned electrode 110*a* can heat the to-be-excited member 120 to be the mercury vapor, and then spread the gaseous mercury all over the planar light source 100 uniformly as shown in FIG. 1B, FIG. 1C, and the FIG. 1D. Same with the first embodiment, to block the electrically connection between the to-be-excited member 120 and the patterned electrode 110*b*. That is, the dielectric layer 111 is also thermal conductive but electrical insulating. The heating device, not limited in planar light source application, can be applied to any light source, rounded shape light source or the tubular shape light source for example, that requires heating the liquid mercury or the mercury alloy to spread the mercury vapor evenly.

Third Embodiment

Figure 3:
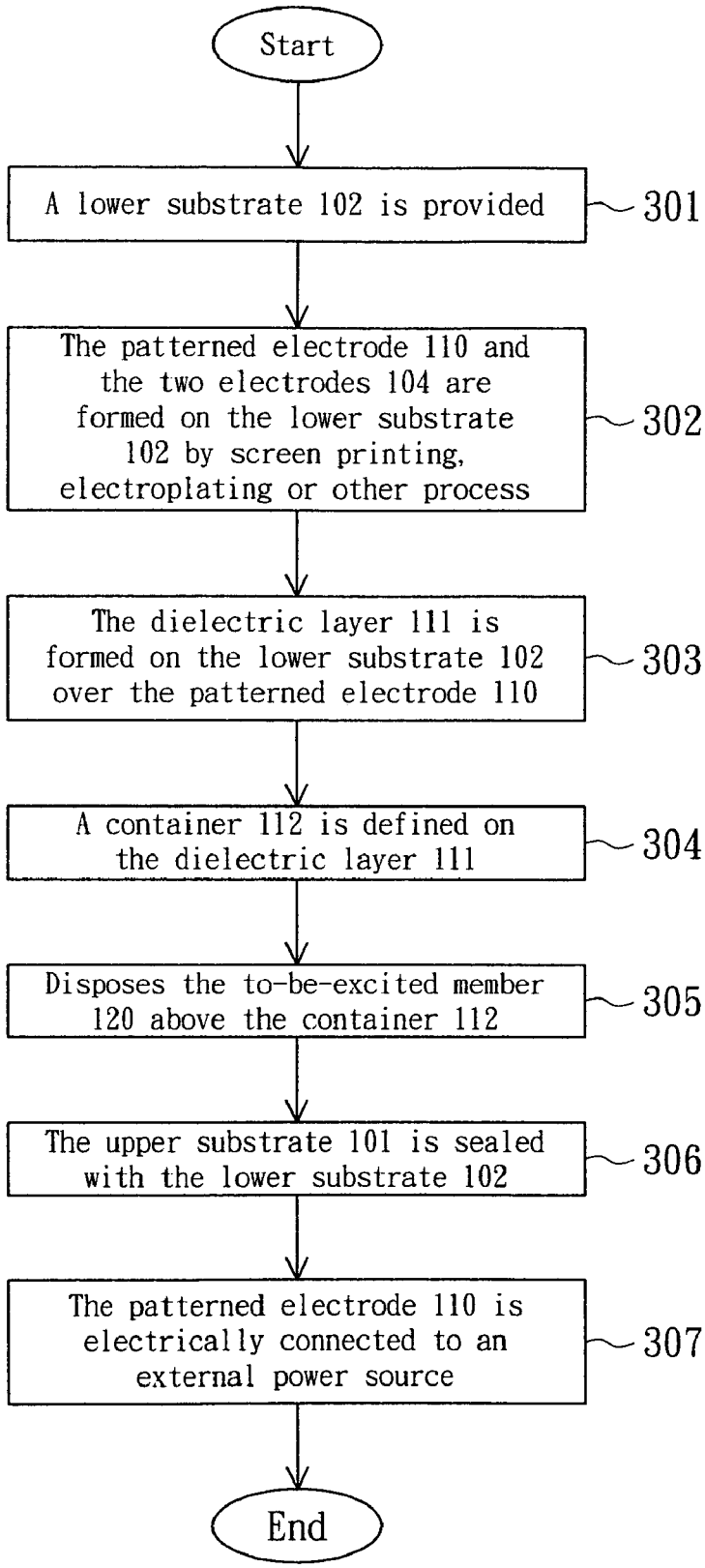
FIG. 3 is the flow chart of manufacturing method for producing a planar light source.

Referring to FIG. 3, the flow chart of method for manufacturing a planar light source with heating device is shown. First, in step 301, a lower substrate 102 is provided. In step 302, the patterned electrode 110 and the two electrodes 104 are formed on the lower substrate 102 by screen printing, electroplating or other process. In step 303, the dielectric layer 111 is formed on the lower substrate 102 over the patterned electrode 110. In step 304, a container 112 is defined on the dielectric layer 111. Instep 305, disposes the to-be-excited member 120 above the container 112. In step 306, the upper substrate 101 is sealed with the lower substrate 102 with discharge gas between. At last, in step 307, the patterned electrode 110 is electrically connected to an external power source so that the to-be-excited member 120 can be heated by the patterned electrode 110 through the dielectric layer 111. When the to-be-excited member 120 is heated, it transforms to be mercury vapor and spreads over the planar light source 100. In this embodiment, the two electrodes and the patterned electrode 110 are formed in a single manufacturing step such as screen printing, electroplating or other process. Therefore, additional cost for manufacturing the patterned electrode is not needed. One further advantage is the cost and time for manufacturing the planar light source with the patterned electrode and the mercury-containing region are highly reduced.

With the disclosure of the heating device in the above embodiments, the patterned electrode connected to the current source or the voltage source is applied to replace the radio frequency heater with relatively high cost. And the container with various shapes such as open box-shaped, concave or rough surface contains the mercury alloy or liquid mercury to be heated into the mercury vapor. The time and cost of heating the mercury alloy or liquid mercury according to the preferred embodiment of the invention is much less than that of the conventional planar light source.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A heating device for a light source, the heating device being disposed between an upper substrate and a lower substrate, the lower substrate being positioned oppositely to the upper substrate, the heating device comprising:

a patterned electrode formed on the lower substrate; and a container, constructed by a dielectric layer, for containing a to-be-excited member, wherein the container is formed on the patterned electrode.

2. The device according to claim 1, wherein the to-be-excited member is mercury.

3. The device according to claim 1, wherein the top of the container is concave.

4. The device according to claim 1, wherein the container comprises a rough surface.

5. The device according to claim 1, wherein the dielectric layer comprises glass, silicon oxide, or lead.

6. A planar light source, comprising:

an upper substrate;

a lower substrate substantially parallel to and positioned oppositely to the upper substrate;

two electrodes respectively disposed between the upper substrate and the lower substrate; and a heating device, disposed between the upper substrate and the lower substrate, the heating device comprising:

a patterned electrode, formed on the lower substrate; and a container, constructed by a dielectric layer, for containing a to-be-excited member, wherein the container is formed on the patterned electrode.

7. The planar light source according to claim 6, wherein the to-be-excited member is mercury.

8. The planar light source according to claim 6, wherein the top of the container is concave.

9. The planar light source according to claim 6, wherein the container comprises a rough surface.

10. The planar light source according to claim 6, wherein the dielectric layer comprises glass, silicon oxide, or lead.

11. The planar light source according to claim 6, wherein said two electrodes are disposed adjacent to the container.

12. A method for manufacturing a planar light source, comprising:

providing a lower substrate;

forming two electrodes and a patterned electrode on the lower substrate;

forming a dielectric layer on the lower substrate to cover the patterned electrode;

defining a to-be-excited member containing region on the dielectric layer; and providing an upper substrate over the dielectric layer, the upper substrate being positioned oppositely to the lower substrate, so that the upper substrate and the lower substrate form an enclosure, the dielectric layer having said to-be-excited member containing region being disposed between the lower substrate and the upper substrate.

13. The method according to claim 12, wherein the patterned electrode and the two electrodes are formed by electroplating.

14. The method according to claim 12, wherein the patterned electrode and the two electrodes are formed by screen printing.

15. The method according to claim 12, further comprising disposing a to-be-excited member above the to-be-excited member containing region.

* * * * *